US010897076B2

(12) United States Patent
Ahmadloo

(10) Patent No.: US 10,897,076 B2
(45) Date of Patent: Jan. 19, 2021

(54) MODULAR ANTENNA SYSTEMS FOR AUTOMOTIVE RADAR SENSORS

(71) Applicant: Veoneer US, Inc., Southfield, MI (US)

(72) Inventor: Majid Ahmadloo, Southfield, MI (US)

(73) Assignee: Veoneer US, Inc., Southfield, MI (US)

( * ) Notice: Subject to any disclaimer, the term of this patent is extended or adjusted under 35 U.S.C. 154(b) by 0 days.

(21) Appl. No.: 16/057,268

(22) Filed: Aug. 7, 2018

(65) Prior Publication Data

US 2020/0052390 A1 Feb. 13, 2020

(51) Int. Cl.

| | |
|---|---|
| ***H01Q 1/32*** | (2006.01) |
| ***H01Q 1/38*** | (2006.01) |
| ***H01Q 21/00*** | (2006.01) |
| ***H01Q 21/06*** | (2006.01) |

(52) U.S. Cl.

CPC ..... *H01Q 1/3233* (2013.01); *H01Q 1/38* (2013.01); *H01Q 21/0025* (2013.01); *H01Q 21/0037* (2013.01); *H01Q 21/065* (2013.01)

(58) Field of Classification Search

CPC .... H01Q 1/3233; H01Q 1/38; H01Q 21/0025; H01Q 21/0037; H01Q 21/065

See application file for complete search history.

(56) References Cited

U.S. PATENT DOCUMENTS

| | | | | |
|---|---|---|---|---|
| 2010/0134376 | A1* | 6/2010 | Margomenos | H01P 5/028 343/848 |
| 2018/0233465 | A1* | 8/2018 | Spella | H01L 23/528 |
| 2019/0089069 | A1* | 3/2019 | Niroo | H01Q 1/2275 |
| 2019/0198974 | A1* | 6/2019 | Ying | H01Q 1/2283 |

FOREIGN PATENT DOCUMENTS

| | | |
|---|---|---|
| EP | 3043382 B1 | 7/2016 |

* cited by examiner

*Primary Examiner* — Robert Karacsony

(74) *Attorney, Agent, or Firm* — Burns & Levinson LLP; Steven M. Mills

(57) ABSTRACT

An antenna system includes a printed circuit board (PCB) on which electronic components are mounted and an antenna module mounted on the PCB. A coupling element on the PCB couples the antenna module to at least one of the electronic components. The antenna module comprises a radio-frequency (RF)-compatible antenna substrate and an antenna structure plurality of antenna patches formed on the RF-compatible antenna substrate.

8 Claims, 13 Drawing Sheets

MODULAR ANTENNA SYSTEMS FOR AUTOMOTIVE RADAR SENSORS

BACKGROUND

1. Technical Field

The present disclosure is related to radar detection systems and, in particular, to a modular antenna system for an automotive radar system and an automotive radar systems utilizing the modular antenna systems.

2. Discussion of Related Art

In conventional automotive radar sensor modules, electronic components are mounted on a printed circuit board (PCB). For example, both transmit (Tx) and receive (Rx) antenna components can be implemented by forming arrays of antenna "patches" on the surface of the PCB. These patches, as well as associated components such as feed lines, strip lines, waveguides and RF transition elements, e. g., waveguide-to-microstrip line transitions, are commonly formed by depositing metal and/or other conductive material on the surface of the PCB in a predetermined desired pattern.

Typical automotive radar systems operate at high radio frequency (RF), for example, 77 GHz. At such frequencies, the electronic characteristics of the PCB, e.g., dielectric constant, can significantly affect performance of the sensor, such as by the coupling of high-frequency Tx antenna signals to the Rx antenna patches or other circuitry in the sensor module. To mitigate the effects of these phenomena, the PCB in conventional sensors has been made of or includes a special high-performance, high-frequency material which reduces these effects. A significant drawback to this approach is that these materials can be very expensive. Also, fabrication of the PCB can be complex and expensive since all of the electronic components in the sensor, including the high-frequency RF components (antennas, feed lines, strip lines, waveguides, RF transition elements, etc.), need to be formed in place on the PCB. Also, all of the associated support circuitry including digital components such as processors, memories, amplifiers, busses, as well as individual passive electronic components, e.g., resistors, capacitors, etc., must also be installed on the surface of the PCB. Also, fabrication processes can negatively affect performance of the RF circuitry and antennas due to the high sensitivity of such components to the material change resulting from exposure to solutions and processes used during fabrication of the PCB.

SUMMARY

According to one aspect, an antenna system is provided. The antenna system includes a printed circuit board (PCB) on which electronic components are mounted and an antenna module mounted on the PCB. A coupling element on the PCB couples the antenna module to at least one of the electronic components. The antenna module comprises a radio-frequency (RF)-compatible antenna substrate and an antenna structure plurality of antenna patches formed on the RF-compatible antenna substrate.

In some exemplary embodiments, the PCB is made of a first material and the RF-compatible antenna substrate is made of a second material different from the first material. A dielectric constant of the first material can be lower than a dielectric constant of the second material. The second material can comprise low-temperature co-fired ceramic (LTCC). The antenna module can be a monolithic microwave integrated circuit (MMIC).

In some exemplary embodiments, the antenna structure comprises a plurality of antenna patches.

In some exemplary embodiments, the antenna structure comprises a plurality of microtrap patches.

In some exemplary embodiments, the antenna structure comprises substrate integrated waveguides (SIW).

In some exemplary embodiments, the antenna structure is a receive antenna structure.

In some exemplary embodiments, the antenna structure is a transmit antenna structure.

In some exemplary embodiments, the coupling element comprises an antenna feeding structure.

In some exemplary embodiments, the antenna feeding structure comprises a microstrip-to-waveguide transition.

In some exemplary embodiments, the antenna system further comprises a mounting structure for mounting the antenna module on the PCB.

In some exemplary embodiments, the mounting structure includes a ball grid array. The BGA can be formed on a bottom surface of the antenna substrate.

In some exemplary embodiments, the antenna feeding structure comprises a via structure.

BRIEF DESCRIPTION OF THE DRAWINGS

The present disclosure is further described in the detailed description which follows, in reference to the noted plurality of drawings by way of non-limiting examples of embodiments of the present disclosure, in which like reference numerals represent similar parts throughout the several views of the drawings.

DETAILED DESCRIPTION

According to the present disclosure, automotive radar sensor modules are provided with modularly fabricated RF components, such as transmit Tx and receive Rx antenna patterns, antenna feed lines, RF strip lines, RF waveguides, RF transition components, through-hole vias, and other RF components. The RF module can then be mounted on a PCB using conventional PCB materials and conventional device mounting techniques and configurations. The PCB in this configuration need not be made of or include any special high-performance high-frequency materials as have been used in conventional approaches. This approach results in substantially reduced cost as well as RF coupling between module components. These modularly designed components of the present disclosure can significantly reduce the effects associated with the drawbacks associated with fabrication materials and processes of the prior art.

Figure 1A:
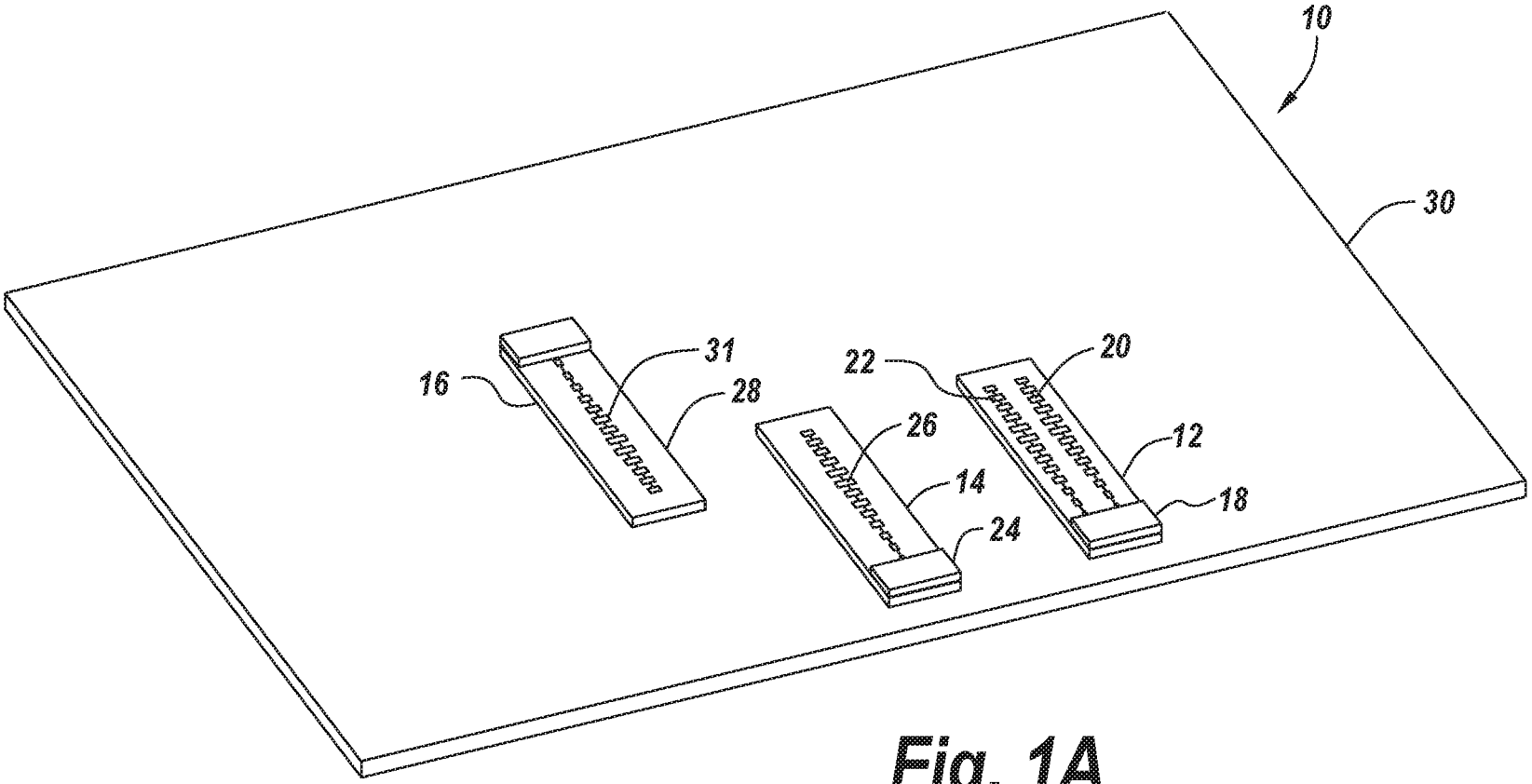
FIG. 1A includes a schematic perspective view of a printed circuit board (PCB) with one or more modular antenna systems mounted thereon, as part of a radar sensor module, such as an automotive radar sensor module, according to some exemplary embodiments.

FIG. 1A includes a schematic perspective view of a printed circuit board (PCB) 10 with one or more modular antenna systems 12, 14, 16 mounted thereon, as part of a radar sensor module, such as an automotive radar sensor module, according to some exemplary embodiments. Referring to FIG. 1A, PCB 10 includes a substrate 30 on which various components, including but not limited to antenna systems 12, 14, 16, can be mounted. In exemplary embodiments, PCB substrate 30 is made of any standard inexpensive PCB material, such as, for example, FR4, which is a well-known National Electrical Manufacturers Association (NEMA) grade designation for glass-reinforced epoxy laminate material. Modular antenna systems 12, 14, 16 can be mounted on substrate 30 by known mounting configurations, such as ball grid array (BGA) configurations, surface mount device (SMD) configurations, or other device mounting configuration. Also, while not shown in FIG. 1A, other electronic components, such as digital components such as processors, memories, integrated circuits, amplifiers, busses, as well as individual passive electronic components, e.g., resistors, capacitors, etc., can also be mounted on PCB substrate 30.

FIG. 1A illustrates three exemplary modular antenna systems 12, 14, 16 mounted on PCB substrate 30. It is noted that these systems are exemplary only and are used in illustrating the principles of the disclosure. Other figurations of modular RF systems, in addition to or instead of any or all of antenna systems 12, 14, 16 can be used within the scope of the present disclosure. Exemplary modular antenna system 12 is shown to include two antenna patch arrays 20, 22 formed on a high-performance high-frequency substrate 18. One of the arrays 20 can be a transmit Tx array, and the other array 22 can be a receive Rx array, or vice versa. Alternatively, both arrays 20, 22 could be Tx arrays or both arrays 20, 22 could be Rx arrays. Exemplary modular antenna system 14 is shown to include a single antenna patch array 26 formed on a high-performance high-frequency substrate 24. Single antenna patch array 26 could be either a Tx array or an Rx array. Similarly, exemplary modular antenna system 16 is shown to include a single antenna patch array 31 formed on a high-performance high-frequency substrate 28. Single antenna patch array 31 could be either a Tx array or an Rx array. Also, other high-frequency RF components, such as antenna feed lines, RF strip lines, RF waveguides, RF transition components, through-hole vias, etc. can be formed on high-performance high-frequency substrates 18, 24, 28.

According to the present disclosure, PCB substrate 30 can be made of relatively inexpensive conventional PCB material, such as FR4, as noted above. However, each of high-performance high-frequency substrates 18, 24, 28 can be made of more specialized RF material, which can be, for example, Astra® MT77 very low-loss high-frequency material, Rogers Corporation RO3003 ceramic-filled polytetrafluoroethylene (PTFE) composite high-frequency circuit material, or low-temperature co-fired ceramic (LTCC) material. While these materials for substrates 18, 24, 28 are more expensive than conventional PCB materials such as FR4, according to the present disclosure, because of the modularization of antenna systems 12, 14, 16, much less of the material is required, which results in substantial reduction in cost and ease of manufacture. Other benefits include higher RF isolation between components due to the elimination of a common substrate between components.

Figure 1B:
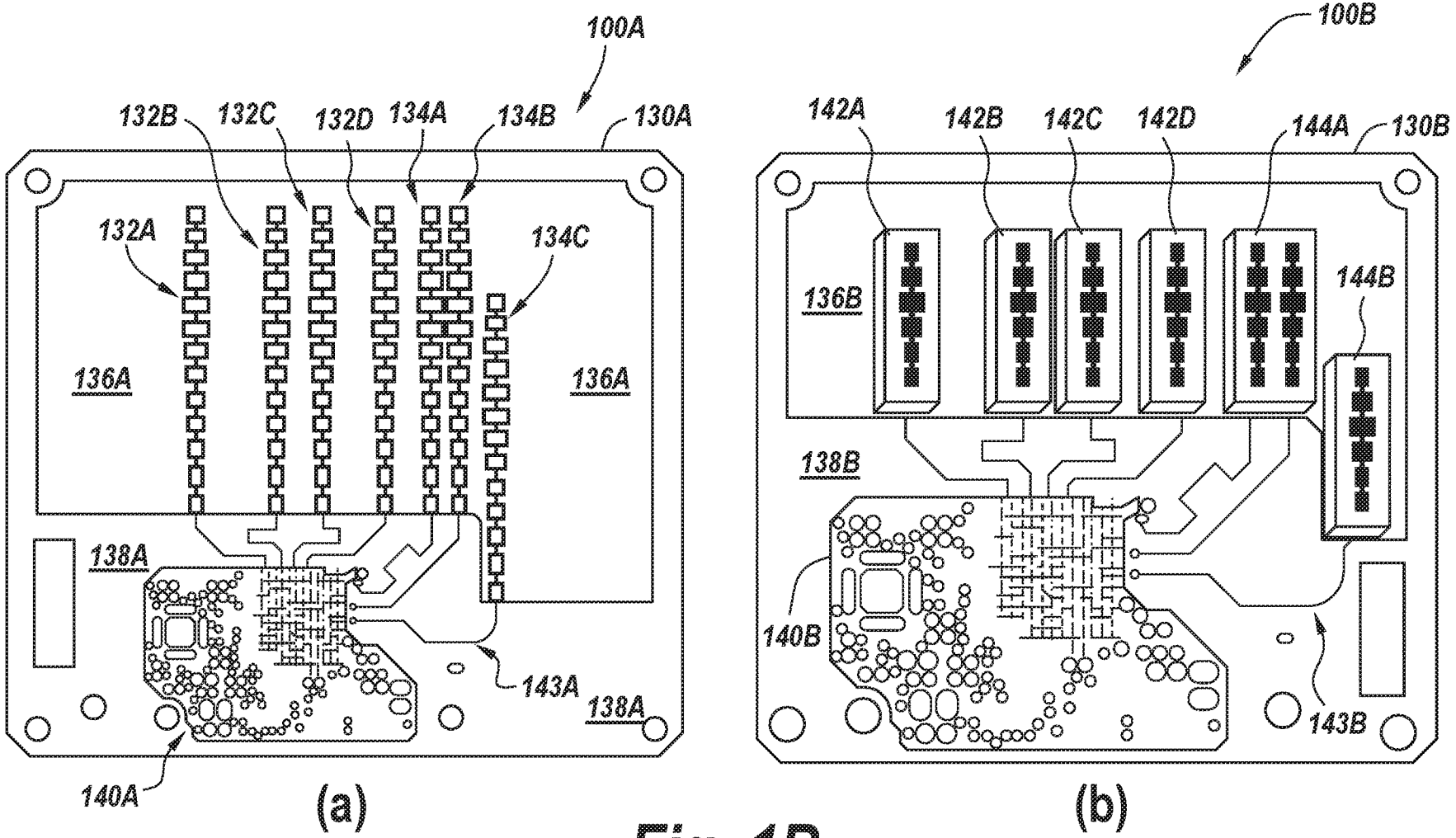
FIG. 1B includes two schematic top views of two respective printed circuit boards (PCBs) illustrating a contrast between a conventional PCB (view (a)) and a PCB according to exemplary embodiments (view (b)).

FIG. 1B includes two schematic top views of two respective printed circuit boards (PCBs) illustrating a contrast between a conventional PCB 100A (view (a)) and a PCB 100B according to exemplary embodiments (view (b)). Referring to PCB 100A of view (a), substrate 130A has formed thereon four Rx antenna patch arrays 132A, 132B, 132C, 132D and three Tx antenna patch arrays 134A, 134B, 134C. Because of the high performance requirements of planar antenna systems, a large region 136A of high-performance high-frequency RF material, such as, for example, Astra® MT77 very low-loss dielectric constant (Dk) material referred to above, is formed on PCB substrate 130A, and antenna patch arrays 132A, 132B, 132C, 132D, 134A, 134B, 134C are formed on region 136A. Associated circuitry 140A, which can include, for example, electronic components, such as digital components such as processors, memories, integrated circuits, amplifiers, busses, as well as individual passive electronic components, e.g., resistors, capacitors, etc., can also be mounted in a second region 138A of PCB substrate 130A, since these devices do not have the same high-frequency performance requirements as antenna patch arrays 132A, 132B, 132C, 132D, 134A, 134B, 134C, and, therefore, need not be mounted in region 136A having the relatively expensive high-performance, high-frequency material. Microstrip lines 143A, connecting circuitry 140A with antenna patch arrays 132A, 132B, 132C, 132D, 134A, 134B, 134C, can also be formed in region 138A of PCB 130A. Alternatively, region 136A can extend to be larger than depicted in the figure such that microstrip lines 143A can be formed in extended region 136A of high-performance, high-frequency material.

Referring to view (b) of FIG. 1B, according to the exemplary embodiments, Rx antenna patch arrays 132A, 132B, 132C, 132D of view (a) are replaced with Rx modular antenna systems 142A, 142B, 142C, 142D, respectively, as described above in connection with FIG. 1A, and Tx antenna patch arrays 134A, 134B, 134C of view (a) are replaced with Tx modular antenna systems 144A and 144B as described above in connection with FIG. 1A. It should be noted that Tx modular antenna system 144A is illustrated as a dual-array system, as an exemplary illustration only. Tx modular antenna system 144A can alternatively be a pair of single-array modular antenna systems, like modular antenna system 144A. It should also be noted that the illustration of four Rx antenna arrays and three Tx antenna arrays is exemplary only. The disclosure is applicable to any number of Rx arrays and any number of Tx arrays in a sensor.

According to the present disclosure, the patch arrays of modular antenna systems 142A, 142B, 142C, 142D, 144A and 144B are formed on individual substrates of high-performance, high-frequency material. As a result, according to the disclosure, region 136B of substrate 130B, on which modular antenna systems 142A, 142B, 142C, 142D, 144A and 144B are mounted, need not include any such material, and is formed of the standard low-cost PCB substrate material, e.g., FR4. Associated circuitry 140B, which can include, for example, electronic components, such as digital components such as processors, memories, integrated circuits, amplifiers, busses, as well as individual passive electronic components, e.g., resistors, capacitors, etc., can also be mounted in a second region 138B of PCB substrate 130B, which does not include the relatively expensive high-performance, high-frequency material. Microstrip lines 143B, connecting circuitry 140B with antenna patch arrays 142A, 142B, 142C, 142D, 144A and 144B can also be formed in region 138B of PCB 130B. Alternatively, region 136B can extend to be larger than depicted in the figure such that microstrip lines 143B can be formed in extended region 136B of high-performance, high-frequency material.

Referring to FIG. 1B, it can be readily observed that, in the configuration of the present disclosure of view (b), the amount of expensive high-performance, high-frequency material needed to implement the sensor is greatly reduced, which results in significant reduction in system cost. In fact, as illustrated in FIG. 1B, the overall size and fabrication complexity and time are also reduced, resulting if further cost reduction. As the overall size of antennas and the monolithic microwave integrated circuits (MMICs) requiring the high-frequency high-performance substrate are relatively small compared to the overall size of the board, more of such components can be placed on the fabrication panel, thereby reducing the amount of expensive RF substrate usage. This will further reduce the manufacturing material cost and potentially bring more informality to the manufacturing process of the antennas and sensitive RF components as such processes may differ from the rest of the board.

Figure 2A:
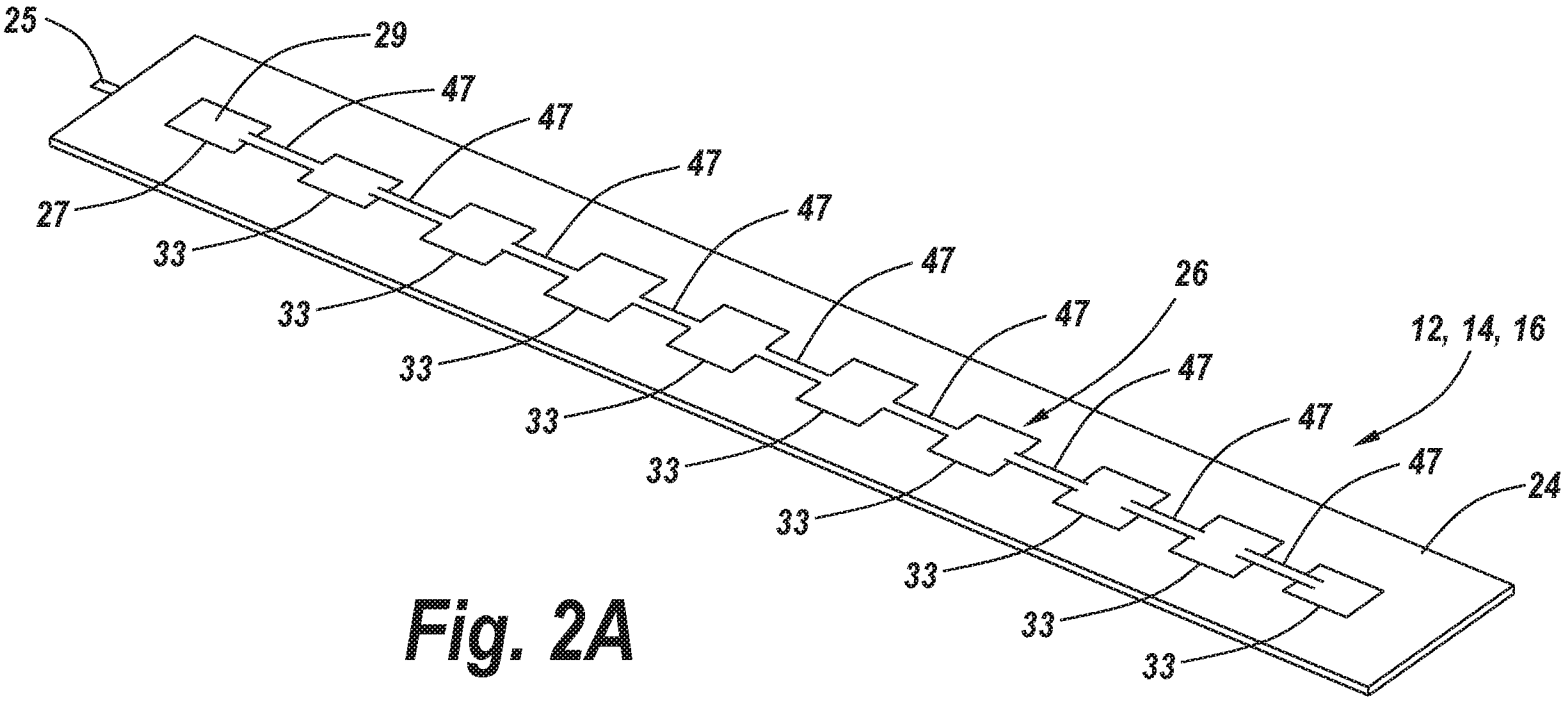
FIG. 2A includes a schematic top perspective view of a modular antenna system as illustrated in FIG. 1A, having a direct via fed configuration, according to some exemplary embodiments.
Figure 2B:
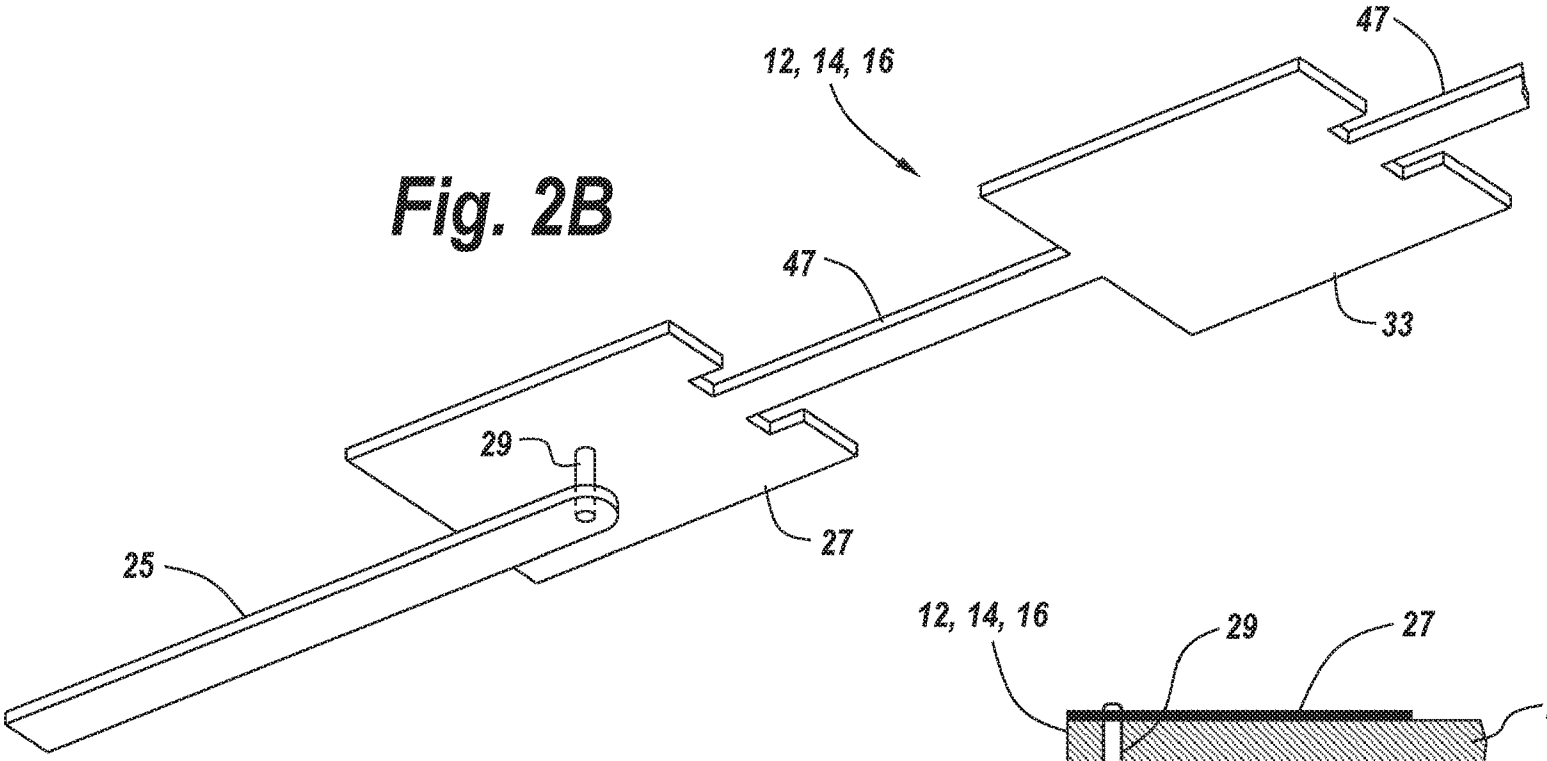
FIG. 2B includes a schematic perspective bottom view of a portion of the modular antenna system of FIG. 2A, according to some exemplary embodiments.
Figure 2C:
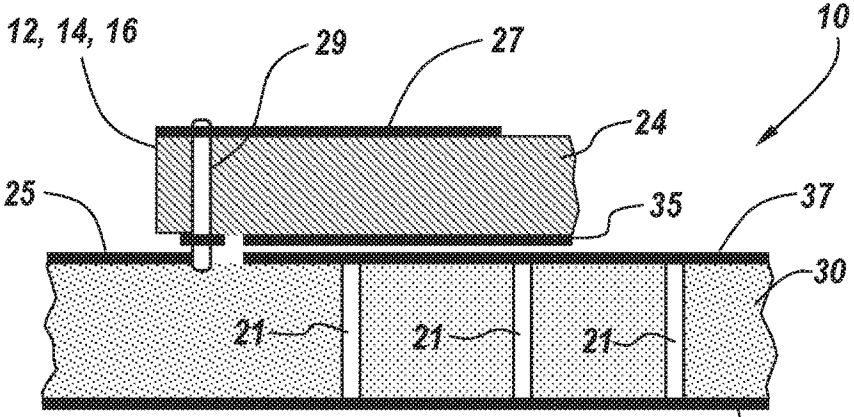
FIG. 2C is a schematic cross-sectional view of a portion of the modular antenna system of FIGS. 2A and 2B, according to some exemplary embodiments.
Figure 2D:
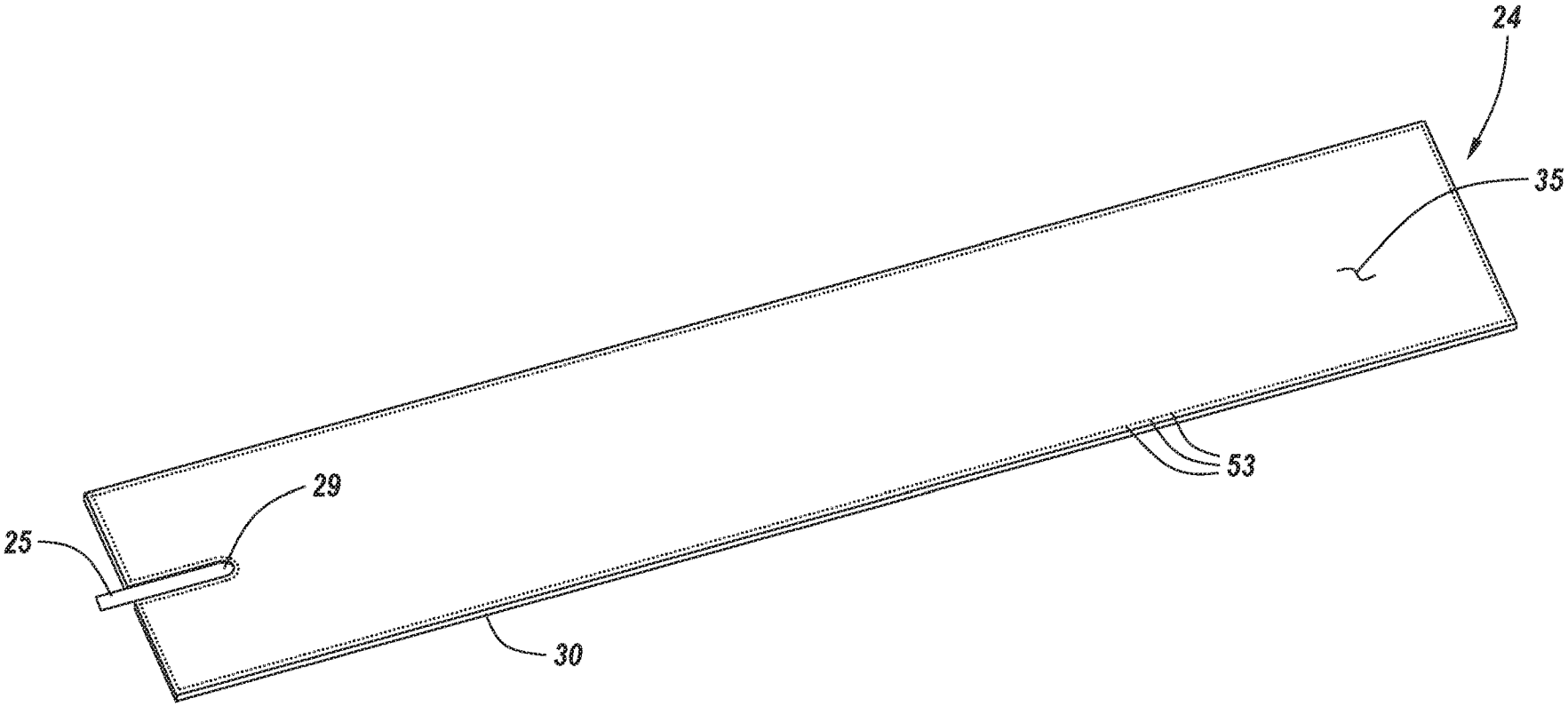
FIG. 2D includes a schematic bottom perspective view of a modular antenna system as illustrated in FIGS. 2A-2C, according to some exemplary embodiments.
Figure 2E:
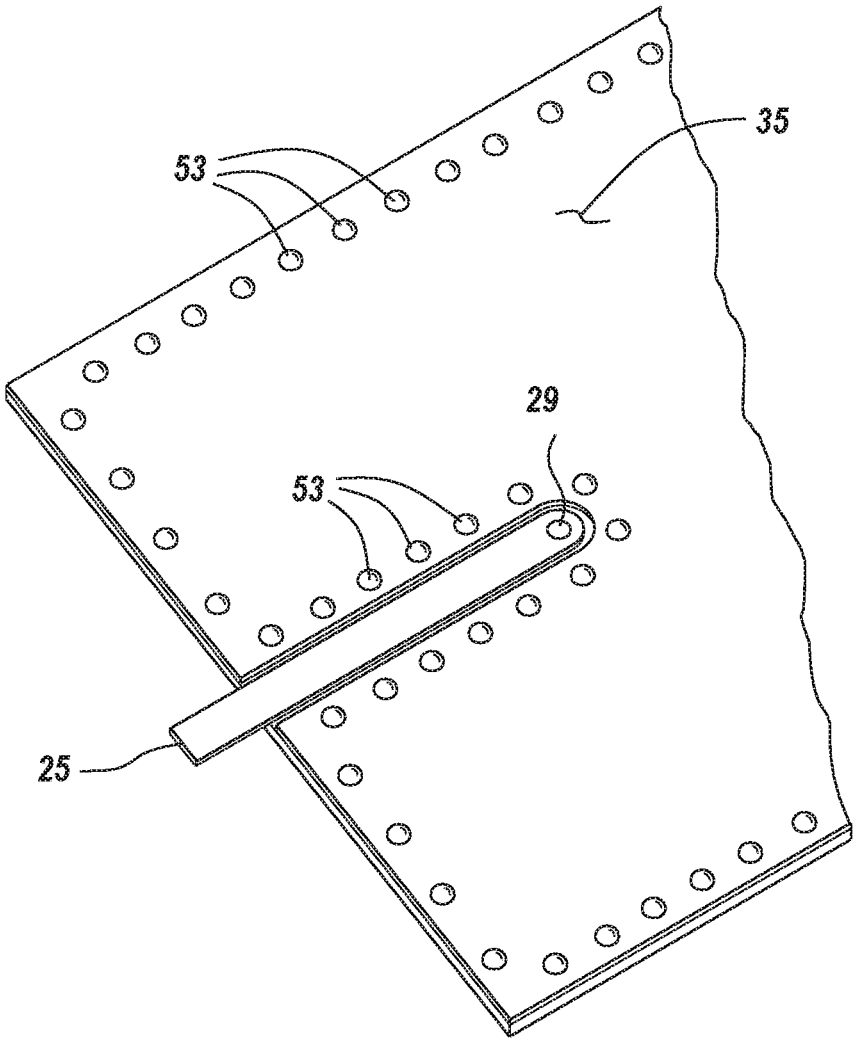
FIG. 2E includes a detailed schematic bottom perspective view of a portion of modular antenna system illustrated in FIG. 2D, according to some exemplary embodiments.

FIG. 2A includes a schematic top perspective view of a modular antenna system 12, 14, 16 as illustrated in FIG. 1A, having a direct via fed configuration, according to some exemplary embodiments. FIG. 2B includes a schematic perspective bottom view of a portion of the modular antenna system of FIG. 2A, according to some exemplary embodiments. FIG. 2C is a schematic cross-sectional view of a portion of the modular antenna system of FIGS. 2A and 2B, according to some exemplary embodiments. FIG. 2D includes a schematic bottom perspective view of a modular antenna system 12, 14, 16 as illustrated in FIGS. 2A-2C, according to some exemplary embodiments. FIG. 2E includes a detailed schematic bottom perspective view of a portion of modular antenna system 12, 14, 16 illustrated in FIG. 2D, according to some exemplary embodiments. Referring to FIGS. 2A-2E, modular antenna system 12, 14, 16 includes a high-performance high-frequency substrate 24, made of, for example, LTCC material, on which is formed antenna patch array 26. It is noted that the selection of substrate 24 and antenna patch array 26 is for purposes of clarity of description. The present disclosure is applicable to any of substrates 18, 24, 28 and any of antenna patch arrays 20, 22, 26, 31 shown in FIG. 1A. Antenna patch array 26 includes multiple antenna patches 33 interconnected by conductive strip lines 47, all of which are formed such as by deposition on the top surface of substrate 24. Modular antenna system 12, 14, 16 is formed on a substrate or PCB 30 as shown in FIG. 1A. In some exemplary embodiments, ground planes 37 and 39 can be formed on opposite surfaces of PCB 30 and can be connected by metallized through-vias 21. The modified RF grounding arrangement for the mountable modular components provides proper grounding between the component and the ground plane of the feeding structure. Similarly, a module ground plane 35 can be formed on the bottom surface of substrate 24 of modular antenna system 12, 14, 16 as shown.

In the exemplary embodiments illustrated in FIGS. 2A-2E, antenna patch array 26 is fed in a direct via configuration. Specifically, a microstrip line 25 for feeding antenna patch array 26 is formed on the top surface of PCB 30. A conductive via 29, formed as a metallized through-via, connects microstrip line 25 directly to a feeding via patch 27 formed on the top surface of substrate 24 of modular antenna system 12, 14, 16, which is electrically connected to antenna patch array 26 by one of conductive strip lines 47. Conductive via 29 can be a solid conductive plug formed in a via hole of a conductive material such as aluminum, copper or other conductive material. Alternatively, conductive via 29 can be a via hole having an interior wall coated with such a conductive material.

Referring specifically to FIGS. 2D and 2E, feed microstrip line 25 is formed at the bottom surface of substrate 24. Direct-feed conductive via 29 is formed at one end of microstrip line 25. Also shown in FIGS. 2D and 2E are ground plane 35 covering the bottom surface of substrate 24 and an array of solder ball points 53 around the perimeter of the bottom surface of substrate 24 for BGA-type mounting of substrate 24 to PCB 30 and grounding of modular antenna system 12, 14, 16.

Figure 3A:
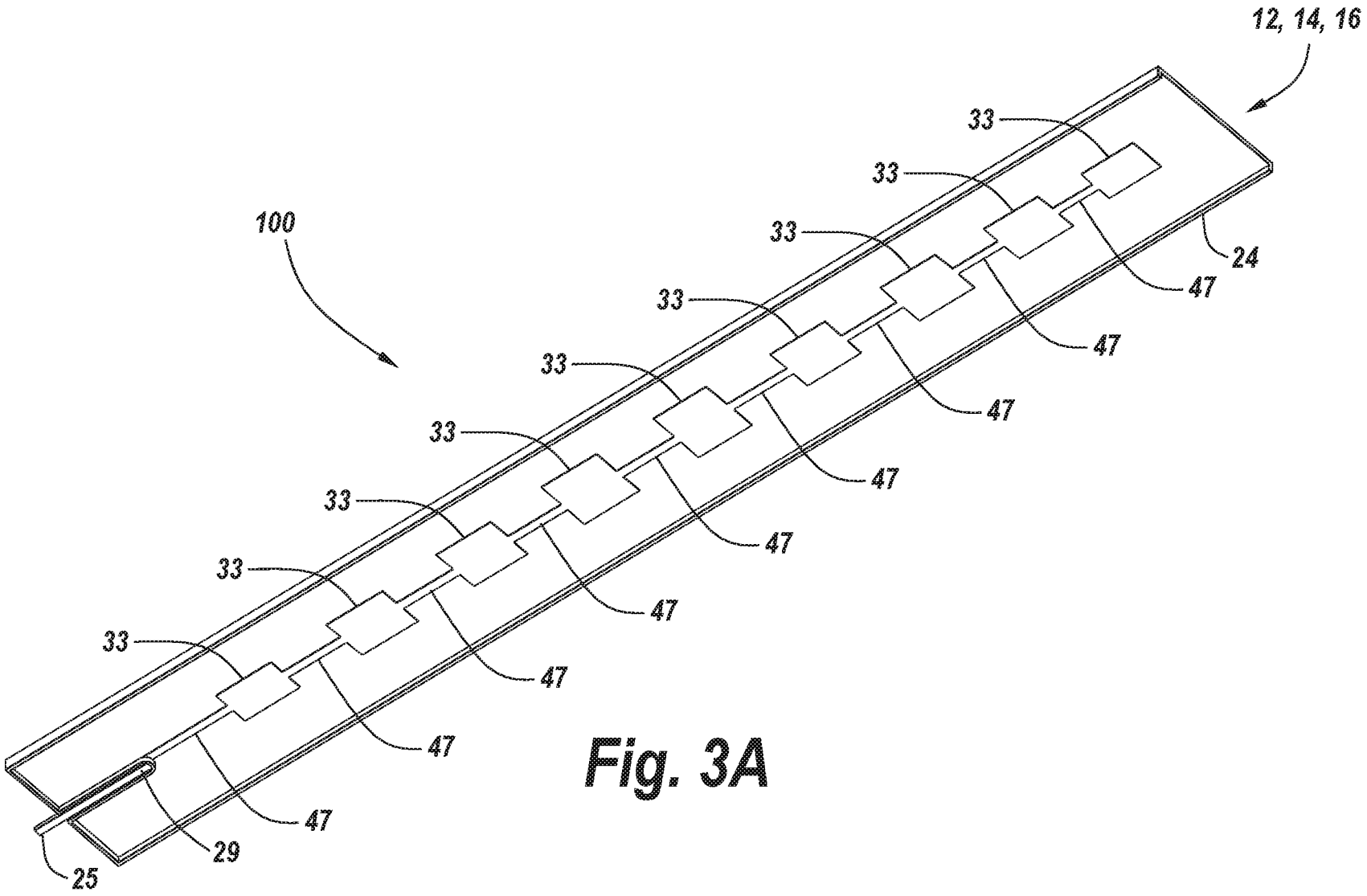
FIG. 3A includes a schematic top perspective view of a modular antenna system as illustrated in FIG. 1A, having an indirect via fed configuration, according to other exemplary embodiments.
Figure 3B:
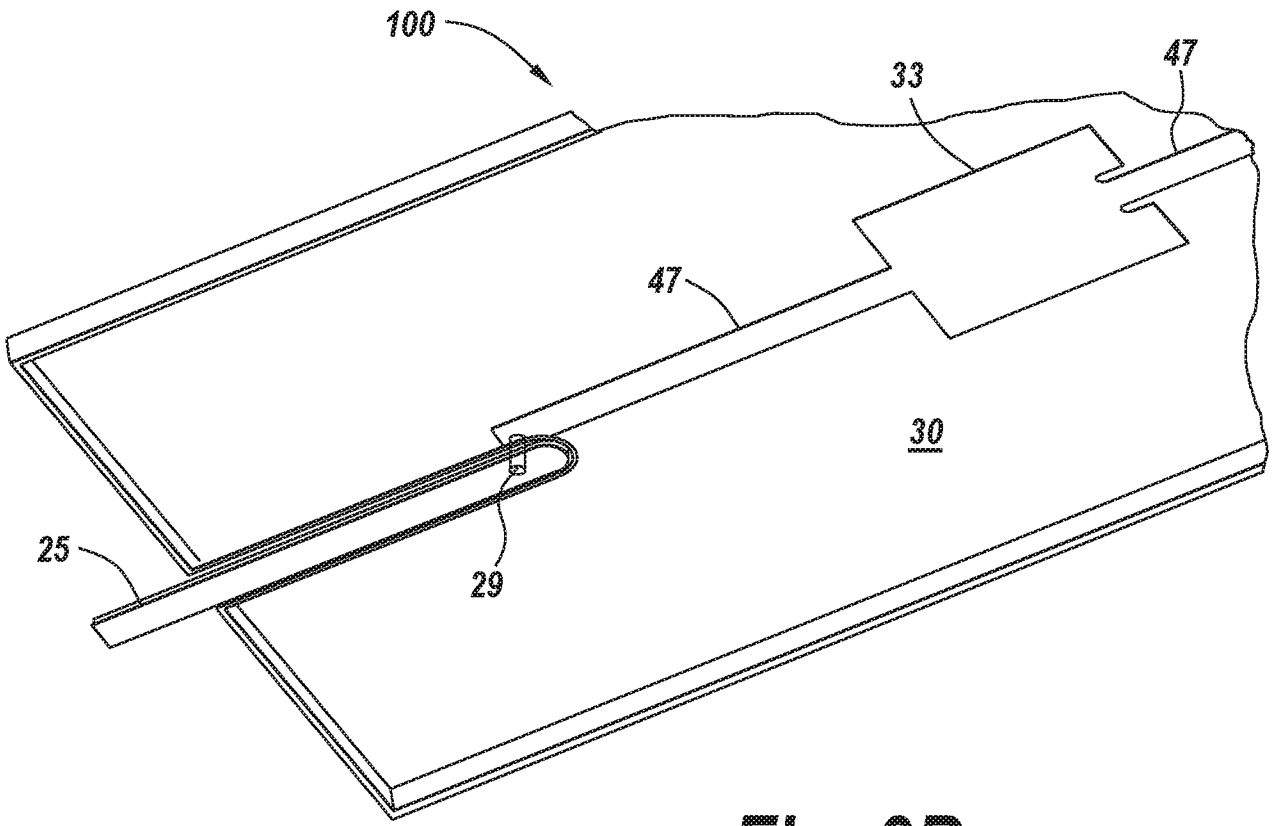
FIG. 3B includes a detailed schematic perspective top view of a portion of the modular antenna system of FIG. 3A, according to some exemplary embodiments.
Figure 3C:
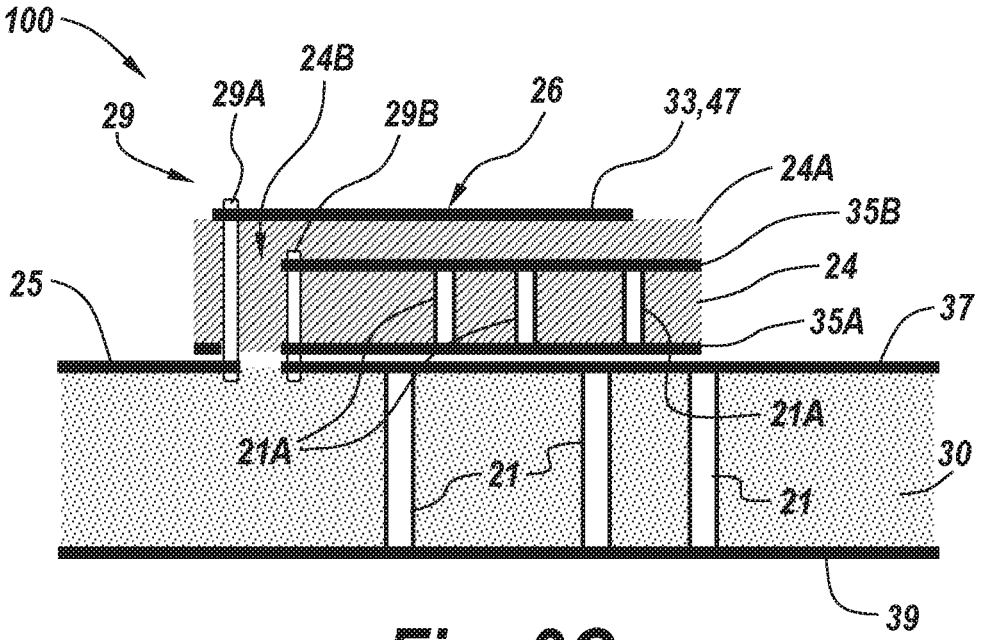
FIG. 3C is a schematic cross-sectional view of a portion of the modular antenna system of FIGS. 3A and 3B, according to some exemplary embodiments.
Figure 3D:
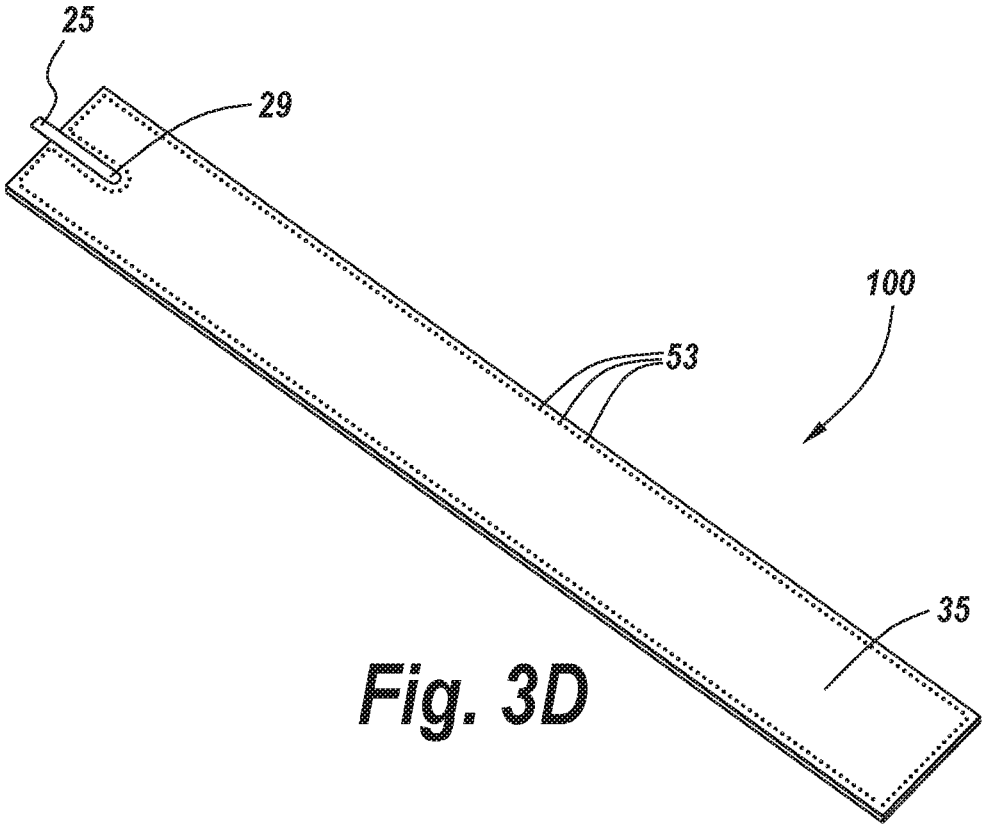
FIG. 3D includes a schematic bottom perspective view of a modular antenna system as illustrated in FIGS. 3A-3C, according to some exemplary embodiments.
Figure 3E:
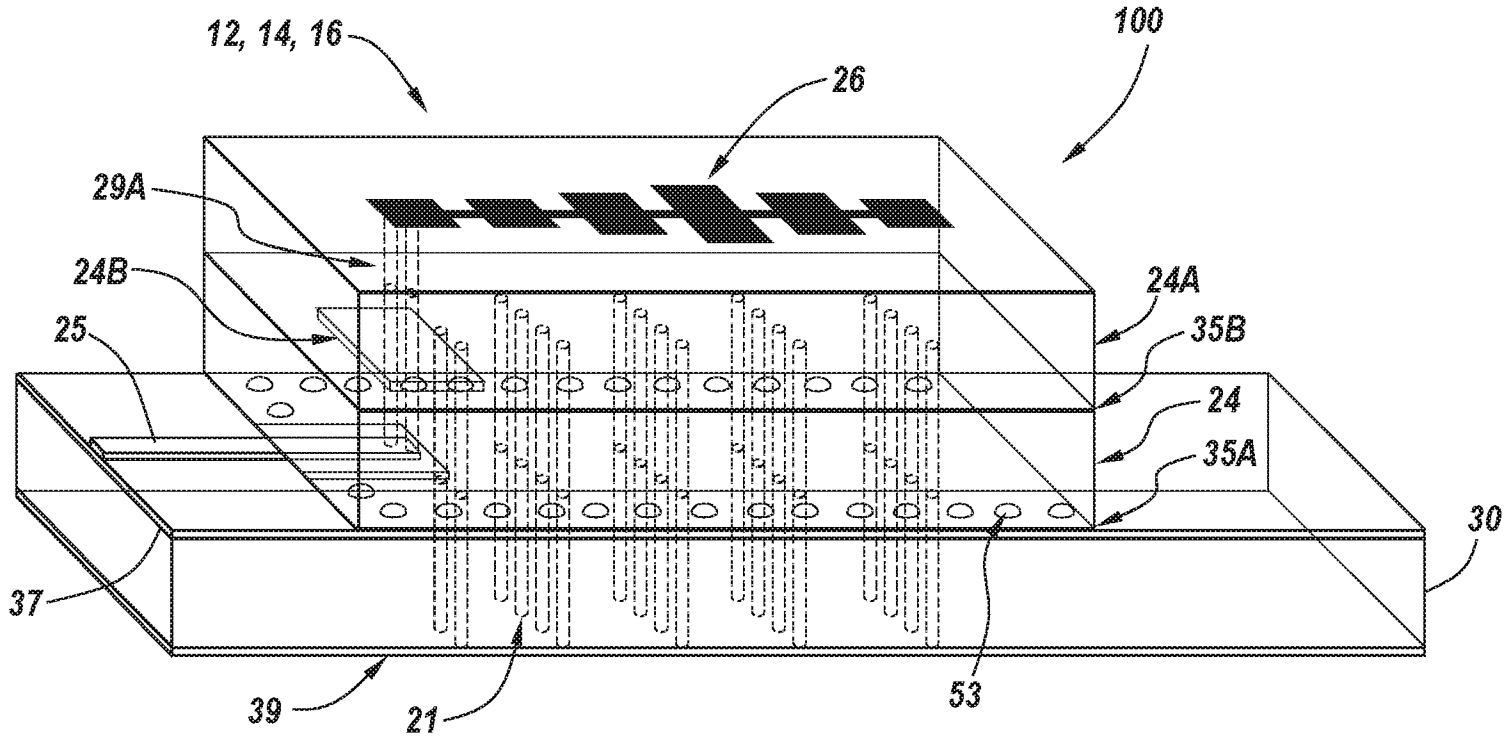
FIG. 3E includes a detailed schematic perspective view of a modular antenna system as illustrated in FIGS. 3A-3D, according to some exemplary embodiments.

FIG. 3A includes a schematic top perspective view of a modular antenna system 100 as illustrated in FIG. 1A, having an indirect via fed configuration, according to other exemplary embodiments. FIG. 3B includes a detailed schematic perspective top view of a portion of the modular antenna system of FIG. 3A, according to some exemplary embodiments. FIG. 3C is a schematic cross-sectional view of a portion of the modular antenna system of FIGS. 3A and 3B, according to some exemplary embodiments. FIG. 3D includes a schematic bottom perspective view of a modular antenna system 12, 14, 16 as illustrated in FIGS. 3A-3C, according to some exemplary embodiments. FIG. 3E includes a detailed schematic perspective view of a modular antenna system 12, 14, 16 as illustrated in FIGS. 3A-3D, according to some exemplary embodiments. Referring to FIGS. 3A-3E, modular antenna system 12, 14, 16 includes a high-performance high-frequency substrate 24, made of, for example, LTCC material, on which is formed antenna patch array 26. It is noted that the selection of substrate 24 and antenna patch array 26 is for purposes of clarity of description. The present disclosure is applicable to any of substrates 18, 24, 28 and any of antenna patch arrays 20, 22, 26, 31 shown in FIG. 1A. Antenna patch array 26 includes multiple antenna patches 33 interconnected by conductive strip lines 47, all of which are formed such as by deposition on the top surface of substrate 24. Modular antenna system 12, 14, 16 is formed on a substrate or PCB 30 as shown in FIG. 1A. In some exemplary embodiments, ground planes 37 and 39 can be formed on opposite surfaces of PCB 30 and can be connected by metallized through-vias 21. Similarly, module ground planes 35A and 35B can be formed on the bottom and top surfaces, respectively, of substrate 24 of modular antenna system 12, 14, 16 as shown. An additional layer 24A of high-performance high-frequency material, made of, for example, LTCC material, is formed over top module ground plane 35B, and antenna patch array 26 is formed over this material 24A.

In the exemplary embodiments illustrated in FIGS. 3A through 3E, antenna patch array 26 is fed in an indirect via configuration. Specifically, a microstrip line 25 for feeding antenna patch array 26 is formed on the top surface of PCB 30 to feed antenna patch array 26 from the bottom side. Conductive via structure 29 includes at least one first conductive via 29A and at least one second conductive via 29B. First conductive via 29A connects microstrip line 25 directly to a feeding via patch 33 or one of conductive strip lines 47 formed on the top surface of substrate 24A. Conductive via 29B connects PCB ground plane 37 and module ground planes 35A and 35B. Through this feeding structure, energy propagates through feeding gap 24B gap between conductive vias 29A and 29B and through material layer 24A, and is coupled to antenna patch array 26, including antenna patches 33 and interconnecting conductive strip lines 47 mounted above. Conductive vias 29A and 29B can be solid conductive plugs formed in a via hole of a conductive material such as aluminum, copper or other conductive material. Alternatively, conductive vias 29A and 29B can be a metallized via hole having an interior wall coated with such a conductive material. Hence, in this configuration, using vias 29A, 29B, a special waveguiding channel is arranged to couple RF energy from the feeding microstrip line into the proposed mounting component from which the coupled energy will be radiated to free space.

Referring specifically to FIG. 3D, feed microstrip line 25 is formed at the bottom surface of substrate 24. Direct-feed conductive via structure 29, including conductive vias 29A and 29B, is formed at one end of microstrip line 25. Also shown in FIG. 3D are ground plane 35 covering the bottom surface of substrate 24 and an array of solder ball points 53 around the perimeter of the bottom surface of substrate 24 for BGA-type mounting of substrate 24 to PCB 30 and grounding of modular antenna system 12, 14, 16.

Figure 4A:
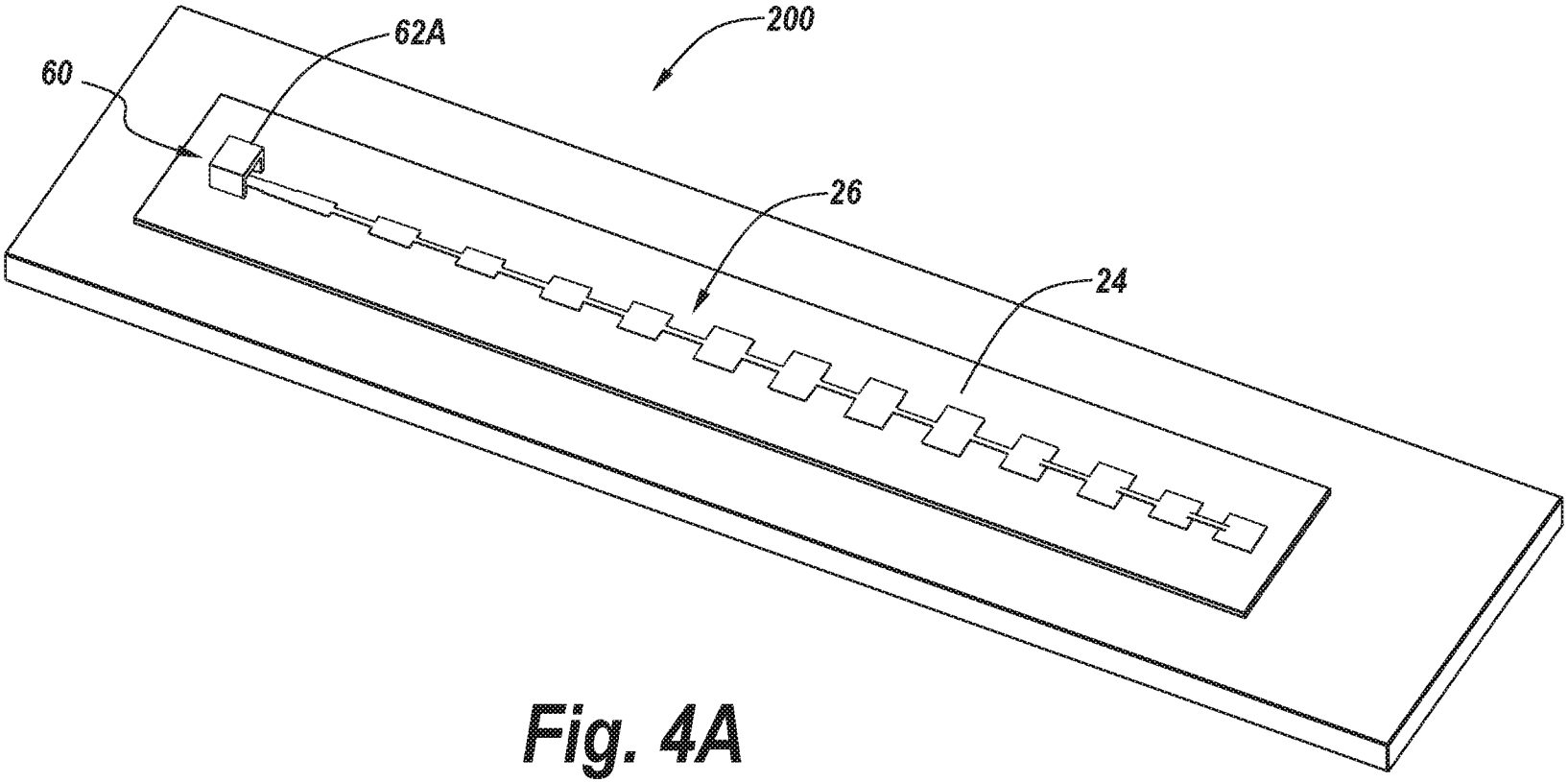
FIG. 4A includes a schematic top perspective view of a modular antenna system as illustrated in FIG. 1A, having a waveguide-to-microstrip feeding configuration, according to other exemplary embodiments.
Figure 4B:
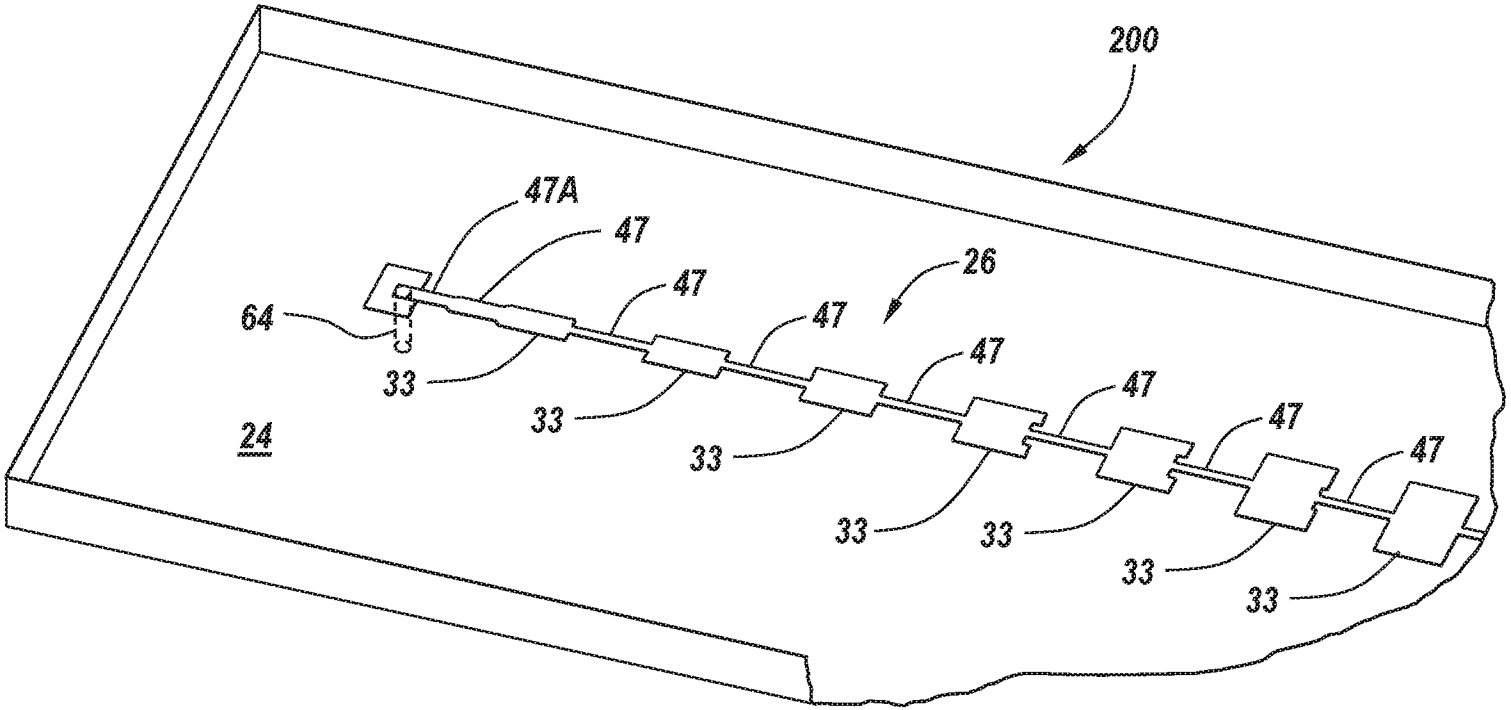
FIG. 4B includes a detailed schematic perspective top view of a portion of the modular antenna system of FIG. 4A, according to some exemplary embodiments.
Figure 4C:
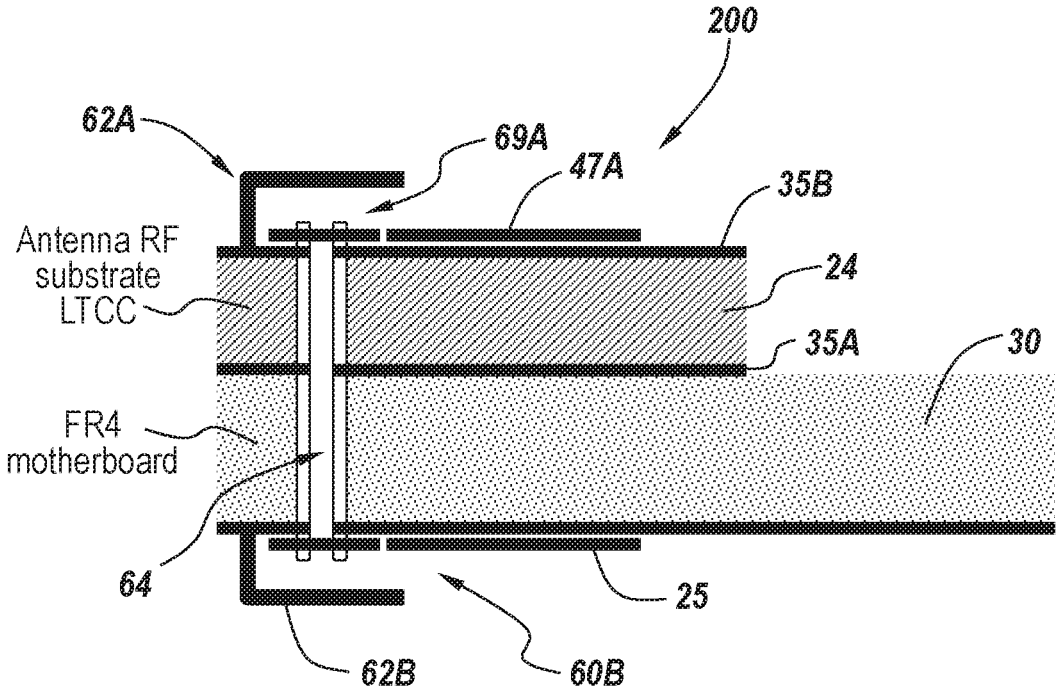
FIG. 4C includes a schematic cross-sectional view of a portion of the modular antenna system of FIGS. 4A and 4B, according to some exemplary embodiments.

FIG. 4A includes a schematic top perspective view of a modular antenna system 200 as illustrated in FIG. 1A, having a waveguide-to-microstrip feeding configuration, according to other exemplary embodiments. FIG. 4B includes a detailed schematic perspective top view of a portion of the modular antenna system of FIG. 4A, according to some exemplary embodiments. FIG. 4C includes a schematic cross-sectional view of a portion of the modular antenna system of FIGS. 4A and 4B, according to some exemplary embodiments.

Referring to FIGS. 4A-4C, modular antenna system 200 includes a high-performance high-frequency substrate 24, made of, for example, LTCC material, on which is formed antenna patch array 26. It is noted that the selection of substrate 24 and antenna patch array 26 is for purposes of clarity of description. The present disclosure is applicable to any of substrates 18, 24, 28 and any of antenna patch arrays 20, 22, 26, 31 shown in FIG. 1A. Antenna patch array 26 includes multiple antenna patches 33 interconnected by conductive strip lines 47, all of which are formed such as by deposition on the top surface of substrate 24. Modular antenna system 12, 14, 16 is formed on a substrate or PCB 30, made of a material such as FR4, as shown in FIG. 1A. Module ground planes 35A and 35B can be formed on the bottom and top surfaces, respectively, of substrate 24 of modular antenna system 12, 14, 16 as shown.

In the exemplary embodiments illustrated in FIGS. 4A through 4C, antenna patch array 26 is fed in waveguide-to-microstrip feeding configuration. Specifically, a microstrip line 25 for feeding antenna patch array 26 is formed on the bottom surface of PCB 30 to feed antenna patch array 26 from the bottom side, via waveguide-to-microstrip transition 60B. Circular waveguide structure 64 is formed through substrate 30 and module substrate 24 and ground planes 35A and 35B to couple energy to microstrip line 47A of patch array 26 via waveguide-to-microstrip transition 60A. Waveguide-to-microstrip transition structures 60A and 60B include metallic caps 62A and 62B, respectively.

According to the present disclosure, an approach to fabrication and placement of antennas and/or other RF components in automotive radar band as components on the manufacturing bill of materials (BOM) reduces manufacturing cost. The configuration described herein substantially reduces RF coupling between components. According to the disclosure, RF components can be modularly fabricated and mounted as a regular component in the manufacturing process. In this approach, a variety of antenna solutions based on the design needs including gain, beam-width, polarization and material requirement can be separately developed and fabricated individually or in a bundled form, for example, receiving antennas in one package and transmitting antenna in a separate package. The mother board can be populate with the modular RF components described herein, in a manner similar to the placement of other components on the rest of the board.

As the overall size of antennas and the monolithic microwave integrated circuits (MMICs) requiring the high-frequency high-performance substrate are relatively small compared to the overall size of the board, more of such components can be placed on the fabrication panel, thereby reducing the amount of expensive RF substrate usage. This will further reduce the manufacturing material cost and potentially bring more informality to the manufacturing process of the antennas and sensitive RF components as such processes may differ from the rest of the board. Another advantage is the ease of placing such components and modular antennas in different orientations as needed in a variety of packaging scenarios. Due to the usage of high-permittivity substrate materials like LTCC, there is a significant reduction in overall antenna size, which can further benefit such placement maneuvers.

Treating antenna units as PCB components can further reduce the manufacturing cost due to the fact that they can be populated on RF boards (cheaper base substrates such as FR4) as a normal component such as a BGA component. One other advantage of this method is the inherent RF separation of such components due to the separation in their common substrate and ground plane, which further reduces the undesirable coupling between antennas, which affects their radiation performances and signal processing aspects related to antenna patterns when placed in close vicinity. This is a common problem in current automotive radar boards, since antennas need to be placed closer and closer to each other to reduce the overall size and also achieve good performance in certain signal processing algorithms which rely on close placement of transmit antennas. The approach of the disclosure provides better RF isolation between transmit and receive channels and can further improve situations in which extreme coupling between components causes issues in design and performance, such as the case of horizontally polarized patches closely positioned alongside each other.

According to the present disclosure, antennas can be selected from a wide variety of designs such as microtrap patches, substrate integrated waveguides (SIW) or a combination form. Feeding of such components can be done with different approaches such as microstrip to waveguide transforms, in some cases feeding vias or coupling patches depending on the operating frequency and design specifications to pass the signal between RF components.

Whereas many alterations and modifications of the disclosure will become apparent to a person of ordinary skill in the art after having read the foregoing description, it is to be understood that the particular embodiments shown and described by way of illustration are in no way intended to be considered limiting. Further, the subject matter has been described with reference to particular embodiments, but variations within the spirit and scope of the disclosure will occur to those skilled in the art. It is noted that the foregoing examples have been provided merely for the purpose of explanation and are in no way to be construed as limiting of the present disclosure.

While the present inventive concept has been particularly shown and described with reference to exemplary embodiments thereof, it will be understood by those of ordinary skill in the art that various changes in form and details may be made therein without departing from the spirit and scope of the present inventive concept as defined by the following claims.

The invention claimed is:

1. An automotive radar antenna system, comprising:

a printed circuit board (PCB) on which electronic components are mounted, the PCB being made of a first material;

an automotive radar antenna module mounted on the PCB, wherein the automotive radar antenna module comprises a radio-frequency (RF)-compatible antenna substrate made of a second material different from the first material, and an automotive radar antenna structure comprising a plurality of antenna patches formed on the RF-compatible antenna substrate;

a mounting structure for mounting the antenna module on the PCB, the mounting structure including a ball grid array (BGA) formed on a bottom surface of the antenna substrate; and a coupling element on the PCB coupling the antenna module to at least one of the electronic components, the coupling element comprising an antenna feeding structure, the antenna feeding structure comprising a microstrip-to-waveguide transition.

2. The automotive radar antenna system of claim 1, wherein a dielectric constant of the first material is lower than a dielectric constant of the second material.

3. The automotive radar antenna system of claim 1, wherein the second material comprises low-temperature co-fired ceramic (LTCC).

4. The automotive radar antenna system of claim 1, wherein the automotive radar antenna structure comprises a plurality of microstrip patches.

5. The automotive radar antenna system of claim 1, wherein the automotive radar antenna structure comprises substrate integrated waveguides (SIW).

6. The automotive radar antenna system of claim 1, wherein the automotive radar antenna structure is a receive antenna structure.

7. The automotive radar antenna system of claim 1, wherein the automotive radar antenna structure is a transmit antenna structure.

8. The automotive radar antenna system of claim 1, wherein the antenna feeding structure comprises a via structure.

* * * * *